US007926824B2

(12) United States Patent
Quendez

(10) Patent No.: US 7,926,824 B2
(45) Date of Patent: Apr. 19, 2011

(54) ROLLER SKATE BRAKING SYSTEM

(75) Inventor: Nicolas Quendez, Hellemmes (FR)

(73) Assignee: Decathlon, Villeneuve d'Ascq (FR)

( * ) Notice: Subject to any disclaimer, the term of this patent is extended or adjusted under 35 U.S.C. 154(b) by 96 days.

(21) Appl. No.: 12/368,377

(22) Filed: Feb. 10, 2009

(65) Prior Publication Data

US 2009/0212520 A1 Aug. 27, 2009

(30) Foreign Application Priority Data

Feb. 12, 2008 (FR) ..... 08 50869

(51) Int. Cl.
*A63C 17/14* (2006.01)

(52) U.S. Cl. ..... 280/11.214; 280/11.215; 280/11.207

(58) Field of Classification Search . 280/11.204–11.208, 11.211, 11.214–11.217
See application file for complete search history.

(56) References Cited

U.S. PATENT DOCUMENTS

| | | | | |
|---|---|---|---|---|
| 5,192,099 | A | 3/1993 | Riutta | |
| 5,478,094 | A | 12/1995 | Pennestri | |
| 5,582,418 | A * | 12/1996 | Closser | 280/11.225 |
| 2007/0132201 | A1 | 6/2007 | Bellehumeur et al. | |

FOREIGN PATENT DOCUMENTS

| | | | |
|---|---|---|---|
| EP | 0 795 348 | A1 | 9/1997 |
| FR | 2 753 106 | A1 | 3/1998 |
| FR | 2 753 635 | A1 | 3/1998 |
| FR | 2 882 271 | A1 | 8/2006 |

OTHER PUBLICATIONS

European Search Report: FA 705645; FR 0850869.

* cited by examiner

*Primary Examiner* — J. Allen Shriver, II
*Assistant Examiner* — Erez Gurari
(74) *Attorney, Agent, or Firm* — Ladas & Parry LLP

(57) ABSTRACT

A roller blade having a frame, at least two rolling systems and a braking system. The frame has a plate on which the rolling systems and a foot blocking device are mounted in line. The braking device includes a braking component. The plate has two portions, one of which, a so-called fixed portion, receives the braking component, and the other one, a so-called mobile portion, receives at least one of the rolling systems positioned under the braking component in order to come into contact with the latter and slow it down when the mobile plate moves closer to the fixed portion. The roller has an actuation device of the braking system arranged on the frame so as to be notably controlled with the foot or leg of the user, the braking system having a triggering device capable of being actuated under the action of the actuation device for passing from a position for blocking the plate during skating, to a position for unblocking the latter during braking allowing both fixed and mobile portions to move closer to each other.

16 Claims, 3 Drawing Sheets

ROLLER SKATE BRAKING SYSTEM

FIELD OF THE INVENTION

The invention relates to an in-line roller blade equipped with a braking system. It will find its application in an industrial environment, at sports equipment manufacturers, notably manufacturers of roller blades, and will most particularly be marketed in sales areas for sports equipment.

BACKGROUND OF THE INVENTION

Two types of rollers blade are notably known, i.e. in-line roller blades consisting of three or four wheels positioned in a line behind each other, and roller blades, more commonly called roller skates, of the "quad" type, i.e. consisting of two transverse axes of rotation, one positioned upstream and the other downstream from the roller blade, each axis receiving a wheel at both of its ends. Additionally, depending on these types of roller blades, the latter comprise a frame consisting of a longitudinal plate on which rolling systems are mounted in line, i.e. the wheels, or even pairs of wheels are positioned in line. Additionally, the frame comprises a device for blocking the foot for firmly attaching the latter to the roller blade. This foot blocking device may for example consist of a piece of footwear, whereby either the foot may be accommodated therein, or a suitable shoe worn by the foot of the user may be blocked therein.

Roller blades equipped with a braking system are known to the person skilled in the art of the field of the invention. According to a first design embodiment, such as the one described in document FR 2 753 106, the roller blade comprises a plate on which wheels are mounted in line; a braking system, comprising a braking component of the pad or even roller type, is arranged under the plate, above at least one of the wheels, notably in the rear portion. Additionally, an actuation device consists of a rod including at least two portions jointed together at the level of the ankle bones, along a transverse pivot axis, the first portion surrounding at least the heel of the foot and the second portion surrounding at least the lower portion of the calf, said second portion of the rod being able to pivot relatively to said first portion in order to actuate the braking system allowing vertical displacement of the braking pad so as to put it into contact with the rear wheel(s) of the roller blade and to slow down the latter. Such a braking system has a risk for the user, notably when the latter cannot control braking, and in particular the movement of his/her leg actuating said second portion of the rod which acts on said braking system. The stability of the user is then not optimum, the latter may topple forwards; consequently there is a risk of falling.

According to another roller blade design embodiment equipped with a braking system, such as those described in documents U.S. Pat. No. 5,478,094 and U.S. Pat. No. 5,192,099, the roller blade comprises a plate on which the wheels rotating about transverse axes of rotation are mounted on the plate. Additionally, this plate comprises a fixed portion on which the three front wheels are mounted, and a mobile rear portion on which the rear wheel is mounted. Moreover, a braking system consists of a braking component of the pad type which is attached to the rear end of the fixed portion, the mobile portion is capable of moving relatively to the fixed portion, optionally by elastic deformation of the plate or by pivoting of the mobile portion relatively to the fixed portion, which allows said mobile portion to be brought closer to said fixed portion, allowing the rear wheel to come into contact onto the pad, and said rear wheel may thereby be slowed down. Such a roller blade design may cause untimely braking when the user involuntarily presses on the rear of the plate, or when the road on which the user skates is more or less deformed or bumped, tending to involuntarily bring the mobile portion closer to the fixed portion.

According to another roller blade design embodiment equipped with a braking system, as described in document FR 2 753 635, the roller blade comprises a plate on which wheels are mounted in line rotating about transverse axes of rotation on the plate. This plate comprises a fixed portion on which the three front wheels are mounted and a mobile portion on which the rear wheel is mounted. Moreover, a braking system is formed by a braking component of the pad type arranged at the rear end of the fixed portion of the plate in order to come into contact with the ground when the mobile portion pivots and moves closer to the fixed portion. Moreover, an actuation device is arranged on the frame of the roller blade so as to be controlled with the leg of the user. Additionally, a triggering device is formed by a locking axis slidably mounted in a linear lumen on the mobile portion and in a lumen at right angles on the fixed portion. With the actuation device the locking axis may be displaced when both lumens match. According to a position of the locking axis located at a first end, simultaneously in both lumens, the fixed portion and the mobile portion are blocked relatively to each other. On the contrary, when the actuation device acts on the locking axis in order to slide it towards a second end, in the right angled portion of the first lumen, the mobile portion may then pivot relatively to the fixed portion of the plate, the locking axis then only sliding towards the top of the right angled lumen on the first fixed portion while remaining blocked at the second end of the linear lumen on the mobile portion.

The object of the present invention applies a roller blade notably overcoming the drawbacks of the roller blade having a design similar to the one described in documents U.S. Pat. No. 5,478,094 and U.S. Pat. No. 5,192,099. Additionally, the present invention is also an alternative design with regard to the roller blade described in FR 2 753 635, notably with regard to the actuation device.

As such, the invention relates to a roller blade, also called roller skate, providing self-control of the braking; when the skater topples forwards, the pressure exerted at his/her heel decreases thereby reducing the effectiveness of the braking and avoiding any forward unbalance.

The roller comprises a frame, at least two rolling systems each consisting of at least one rotatably mounted wheel on a transverse axis of rotation, and at least one braking component. The frame comprises at least one longitudinal plate on which the rolling systems are mounted in line and one device for blocking the foot intended to firmly attach the latter to the roller blade. The braking component is positioned above at least one of the rolling systems in order to come into contact with the latter and to slow it down. Moreover, the plate has two portions, one of which, a so-called fixed portion, is firmly attached to the foot blocking device and receives the braking component, while the other portion, a so-called mobile portion, receives the rolling systems positioned under the braking component; when the mobile portion moves closer to the fixed portion, the rolling system comes into contact with the braking component. The roller blade also comprises a device for actuating the braking component, said actuation device being arranged on the frame so as to be controlled by the user, notably with the foot or the leg, or even with the hand.

According to the invention, the roller blade comprises a triggering device consisting of a pusher, notably consisting of a connecting rod, and a triggering part. The connecting rod is mounted as a pivot link, at one of its ends with the actuation device on the one hand and, at the other of its ends with the triggering part on the other hand. Additionally, the triggering part consists of at least one plate-shaped plate, adjacent to the rolling system, said plate being mounted so as to rotate about a transverse axis or so as to translationally and longitudinally move with the fixed portion, notably at its rear end, and translationally move with the mobile portion, for passing from a locking position to an unlocking position under the action of the actuation device, said plate blocking the separation between said fixed and mobile portions during locking, and on the contrary, allowing them to move closer to each other during the unlocking.

Thus, the triggering device is capable of being actuated under the action of the actuation device for passing from a position for blocking the plate during skating and to a position for unblocking the latter during braking allowing the fixed portion to move closer to the mobile portion in order to cause the rolling system to come into contact with the braking component. Such a design has the advantage of avoiding untimely and involuntary braking actions while practicing skating. Moreover, the pressure exerted by the weight of the skater and his/her inertia on the rear of the roller blade allows the mobile portion to move closer to the fixed portion and thus causing the rolling system to contact the braking component. The pressure is consequently more or less significant depending on the weight and on the inertia of the skater.

Preferentially, the longitudinal plate is slit over a part of its length, notably from its rear end, so as to form the fixed portion and the mobile portion, and to allow said mobile portion to move closer to the fixed portion by elastic deformation of said plate. Other embodiments may be contemplated; for example a fixed portion may be provided on the frame and a mobile portion mounted as a pivot link at its end, with the front end of said fixed portion.

According to a preferential design embodiment, the braking component consists of a rotatably mounted roller along a transverse axis of rotation on the fixed portion. Additionally, the rolling system consists of a single wheel rotatably mounted on an axis of rotation; this wheel is capable of coming into contact with the roller when the mobile portion moves closer to the fixed portion.

According to an alternative design, the braking component consists of two rollers rotatably mounted along a transverse axis of rotation, the rollers being positioned on the lateral sides of the fixed portion. Additionally, the rolling system consists of two wheels rotatably mounted on an axis of rotation, said wheels being positioned on the lateral sides of the mobile portion. These wheels are capable of coming into contact with the rollers when the mobile portion moves closer to the fixed portion, i.e. when the triggering device is unlocked. According to this design, the roller is more currently designated as a roller skate or "quad" system.

According to a first embodiment, the actuation device consists of a rod which includes at least two portions jointed to one another, notably at the ankle bone level, along a transverse pivot axis. The first portion surrounds at least the heel of the foot positioned inside a piece of footwear. Additionally, the second portion surrounds at least the lower portion of the calf; the pivoting of the second portion of the rod, by action of the leg, allows the calf to be supported on the second portion, actuating the connecting rod.

According to an alternative design, the actuating device consists of a part arranged under the front end of a piece of footwear forming the foot blocking device, this actuation part being firmly attached to the braking system; the part may be moved and also the rod may be actuated by deformation of the piece of footwear.

Other alternative designs of the pushing rod may be contemplated; an electronic or automatic pusher may notably be designed, which acts directly or in combination with a connecting rod, on the triggering part. In this case, the actuation device for example consists of a control box actuated with the foot or with the hand and triggering the electronic or automatic pusher.

BRIEF DESCRIPTION OF THE DRAWINGS

Other features of the present invention will become apparent during the following description in support of the figures wherein:

FIGS. 1 and 2 show a first design embodiment of the triggering device;

DETAILED DESCRIPTION OF THE PREFERRED EMBODIMENTS

Figure 1:
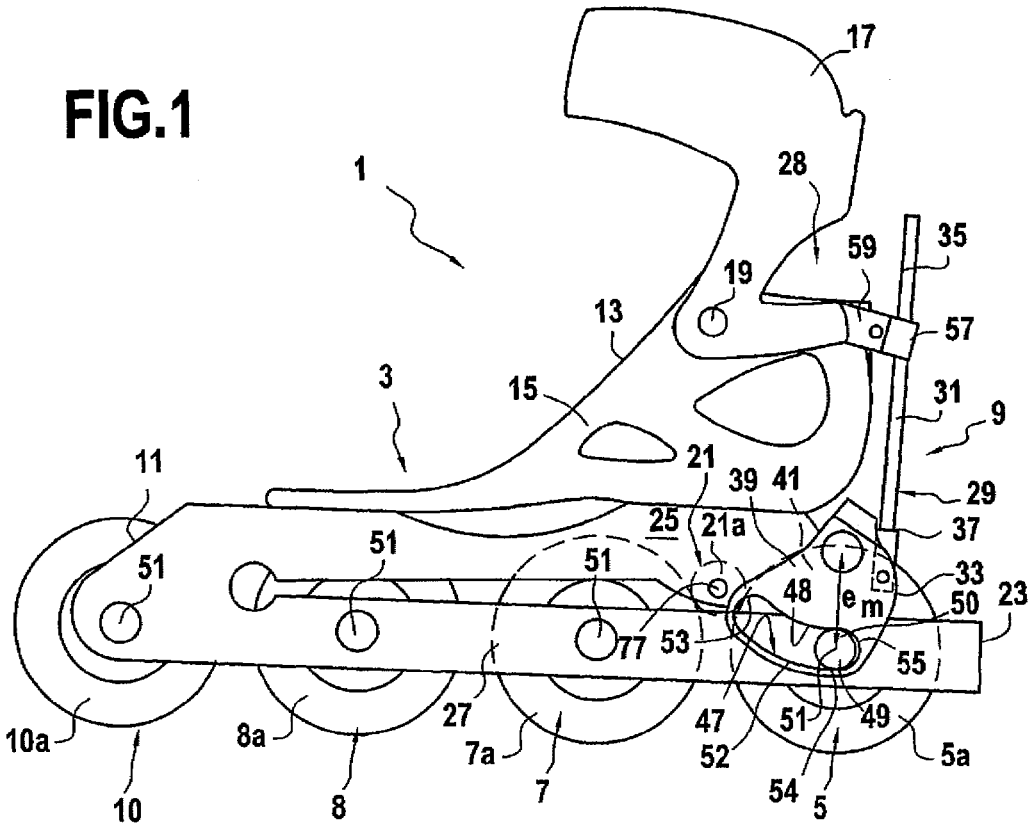
FIGS. 1 and 2 illustrate a first design embodiment of the roller blade showing four wheels positioned in line and mounted so as to rotate about transverse axes of rotation, each wheel rotatably mounted along a transverse axis of rotation forming a rolling system. Additionally, these

According to the different design embodiments of the present invention, as illustrated in FIGS. 1-4, the roller blade 1 is equipped with a frame 3 which comprises a longitudinal plate 11. This longitudinal plate 11 consists of two portions 25, 27; the first portion 25 is said to be "fixed" in the following description, while the second portion 27 is said to be "mobile". However said first portion 25 may be considered as mobile and said second portion 27 as fixed.

Figure 2:
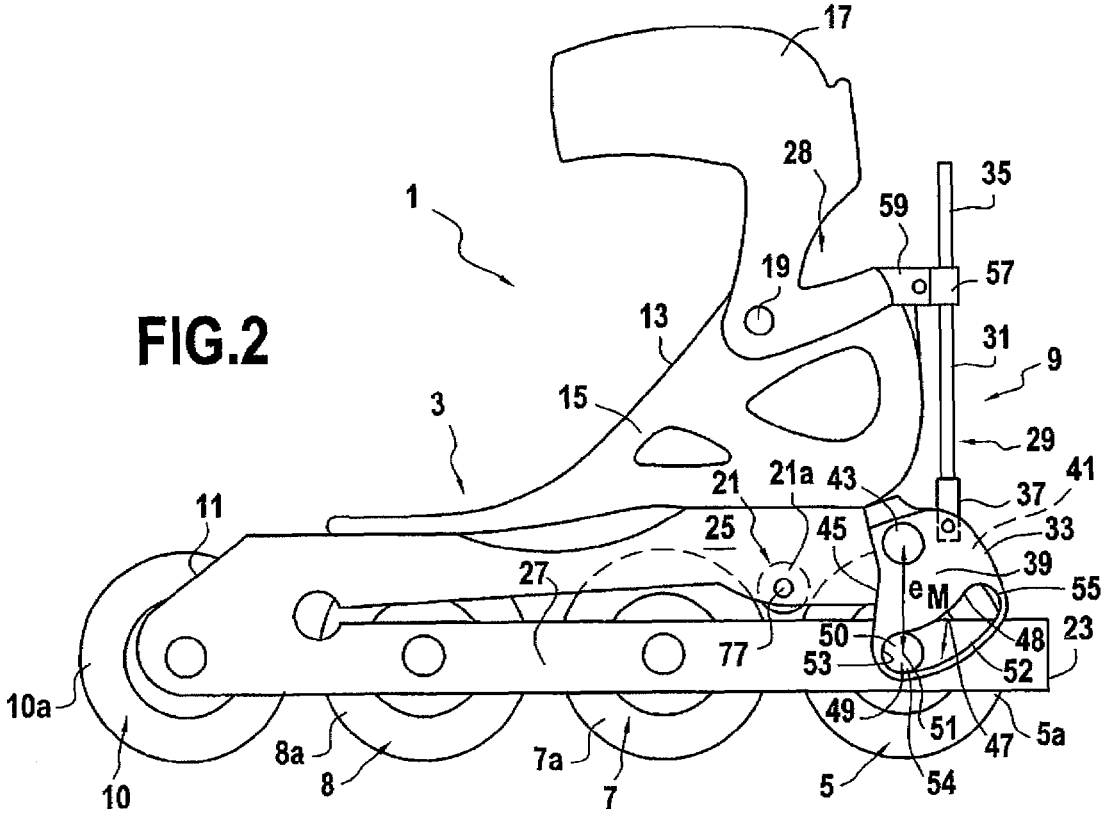

According to the design embodiment illustrated in FIGS. 1 and 2, the longitudinal plate 11 is slit over a portion of its length, from its rear end 23. With such a slit on the plate 11, it is possible to form the fixed portion 25 and the mobile portion 27. Additionally, the material selected for making the plate 11 notably designed in a composite material, allows elastic deformation of said plate 11 in order to allow the fixed portion 25 and mobile portion 27 to move closer to each other. This slit is preferably made horizontally on the plate.

Figure 4:
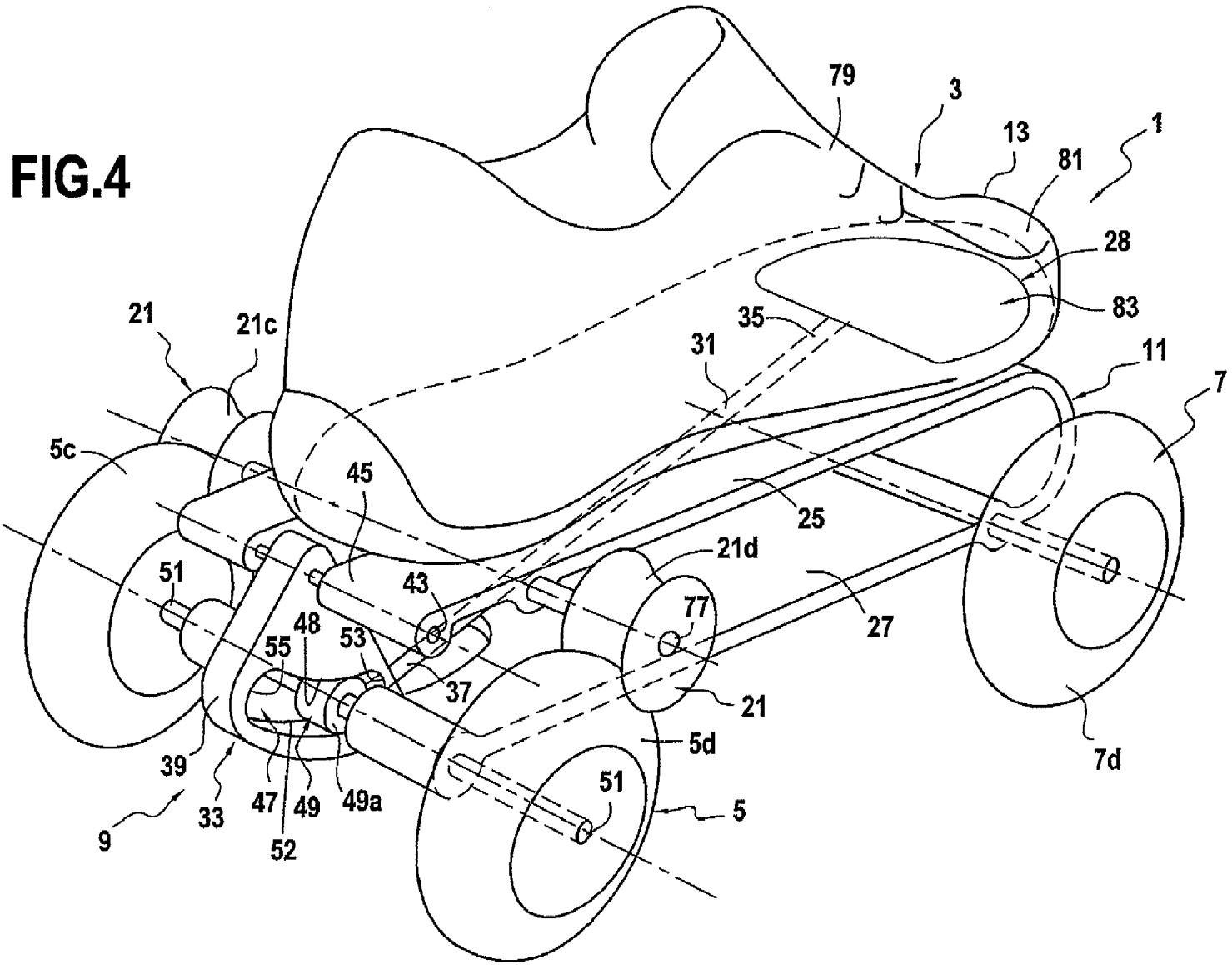
FIG. 4 illustrates an alternative design of the roller blade on which the rolling systems positioned in line on the plate, consist of a transverse axis of rotation and of two wheels positioned at the side ends of said axis of rotation, said roller blade being then preferably designated as roller skate or "quad"

Other alternatives may be contemplated, such as for example the one illustrated in FIG. 4 wherein the plate 11 consists of a flexible part bent at its front end and forming an elongated and slanted U, a portion of which forms the mobile portion 27 and the other portion forms the fixed portion 25. According to another alternative, provision may also be made for a pivot link between two parts, one forming the fixed portion 25 and the other forming the mobile portion 27.

According to the various designs illustrated in FIGS. 1-4, the roller blade comprises at least two rolling systems. According to a first design embodiment illustrated in FIGS. 1-2, four rolling systems are applied. These rolling systems 5, 7, 8, 10 each consist of wheels 5*a*, 7*a*, 8*a*, 10*a* mounted in line behind each other in the central portion on the plate. These wheels 5*a*, 7*a*, 8*a*, 10*a* are rotatably mounted along transverse axes of rotation 51. According to this design illustrated in FIGS. 1-2, the plate 11 and notably the mobile portion 27 is arranged in order to allow the wheels 5*a*, 7*a*, 8*a*, 10*a* to be housed in the central portion. Additionally, the front wheel 10*a* is arranged at the front end of the fixed portion 25 while the three rear wheels 5*a*, 7*a*, 8*a* are arranged on the mobile portion 27, which allows these three wheels 5*a*, 7*a*, 8*a* to move closer to said fixed portion 25.

According to an alternative design illustrated in FIG. 4, the roller blade comprises two rolling systems positioned at the front and rear ends on the plate 11. According to this design, the rolling systems 5, 7 each consists of two wheels 5*c*, 5*d*, 7*d*. According to this design, the first rolling system 5 is positioned at the rear end of the mobile portion 27 and the second rolling system 7 is positioned at the front end of the mobile portion 27; during deformation of the plate 11, only the rear wheels 5*c*, 5*d* are capable of moving closer to the fixed portion 25.

According to these various designs, the roller blade 1 comprises a braking system 9. This braking system 9 includes at least one braking component 21. According to the first embodiment of the roller 1 illustrated in FIGS. 1-3, the braking component 21 consists of a single braking roller 21*a* and is positioned above both rear wheels 5*a*, 7*a* so as to come into contact with the latter when the mobile portion 27 moves closer to the fixed portion 25. Concerning the second embodiment illustrated in FIG. 4, the braking component 21 consists of two braking rollers 21*c*, 21*d* positioned on the lateral sides of the plate, on the fixed portion 25, these rollers 21*c*, 21*d* being positioned above the rear wheels 5*c*, 5*d* or even slightly shifted relatively to the latter, so that when the fixed portion 25 and the mobile portion 27 move closer together, the rear wheels 5*c*, 5*d* will come into contact on the rollers 21*c*, 21*d*. According to these various design embodiments illustrated in FIGS. 1-4, it is noted that the roller is rotatably mounted along an axis of rotation 77 on the fixed portion 25.

Moreover, the roller blade 1 is equipped with a foot blocking device 13. This blocking device 13, according to the design embodiments illustrated in FIGS. 1-3, notably comprises blocking means allowing the attachment of a piece of footwear such as a shoe capable of cooperating with said blocking means. Such a design notably has the advantage of being able to replace the piece of footwear if need be while keeping the roller blade 1. According to an alternative design, as illustrated in FIG. 4, the foot blocking device 13 may be directly applied by means of a piece of footwear arranged on the upper portion of the longitudinal plate 11, i.e. firmly attached to the fixed portion 25.

The roller blade 1 comprises a device for actuating the braking system. This actuation device 28 is preferably arranged on the frame 3 so as to be controlled with the foot or with the leg, so as to actuate the braking system. Different design embodiments of the device for actuating the braking system are applied in FIGS. 1-4.

Figure 3:
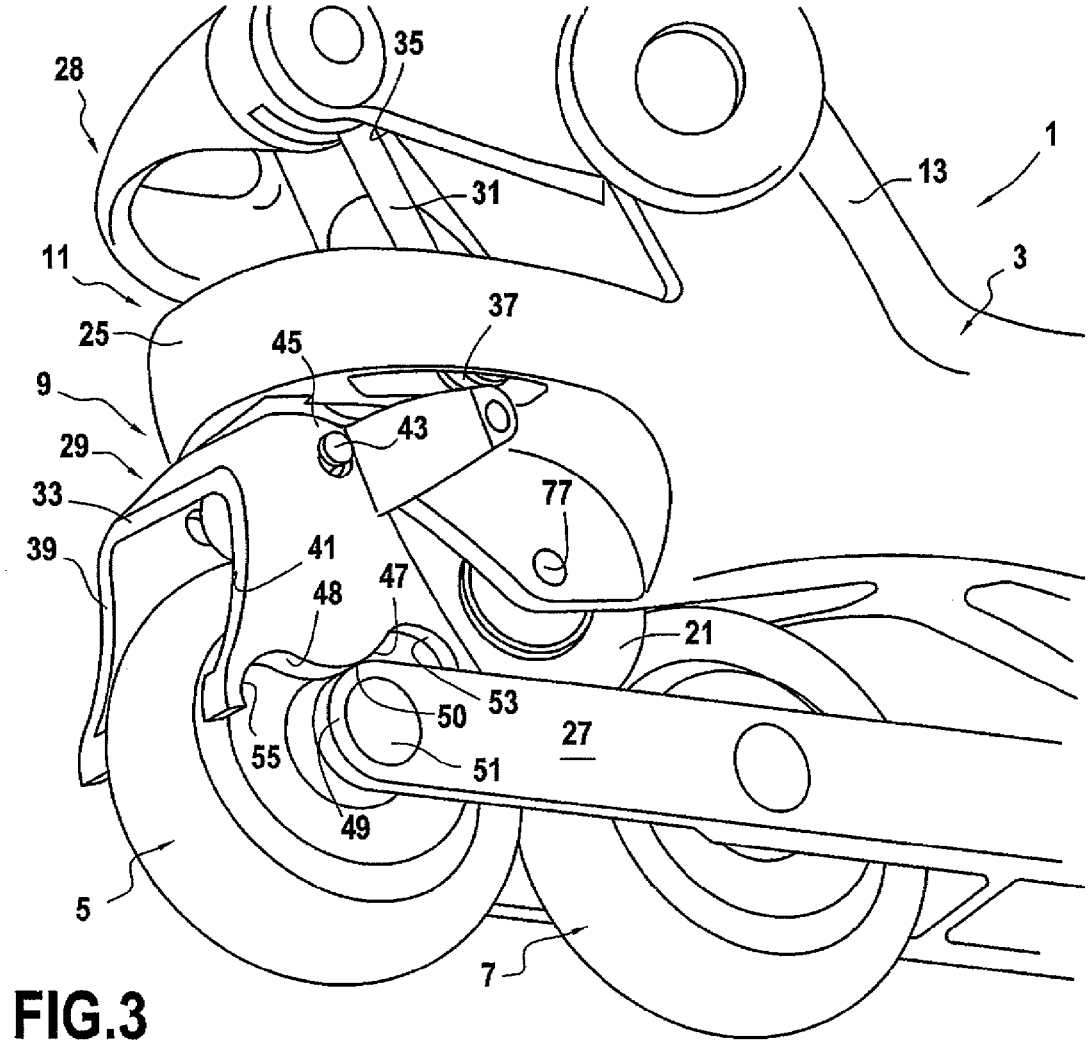
FIG. 3 illustrates an alternative design of the triggering device as illustrated in FIGS. 1 and 2.

According to a first embodiment illustrated in FIGS. 1-3, in which the roller blade 1 comprises four wheels in line, the actuation device 28 consists of a rod notably including two portions 15 and 17 jointed to each other, this joint being formed by means of a transverse pivot axis 19 arranged between the first lower portion 15 and the second lower portion 17, the link being notably located at the ankle bones. Additionally, the first portion 15 is firmly attached to the fixed portion 25 of the plate 11, this first portion 15 of the rod participating in receiving the foot or the piece of footwear, notably for blocking the heel of the foot. The second upper portion 17, as for it, is arranged in order to surround at least the lower portion of the calf, as well as the lower portion of the shin. Thus, by front and rear movements of the leg, the shin and the calf are able to be supported on said upper portion 17 of the rod and to cause the latter to pivot forwards or rearwards relatively to the lower portion 15, with the purpose of actuating the braking system connected with said second portion 17 of the rod.

According to an alternative design as illustrated in FIG. 4, the actuation device 28 of the braking system 9 is arranged under the front end of the piece of footwear 79 consisting of a shoe strictly speaking. This actuating device consists of an actuation part 83, preferably with the shape of a cut-out plate so as to fit the front end of the sole. Additionally, the shoe is firmly attached to the plate 11 on all of its rear portion, preferably, while the front portion in which the part 83 is located, is free relatively to the plate 11, with which the front portion of the piece of footwear 79 may be deformed and thus the actuating part 83 may be moved, the latter being connected with the braking system so as to act on the latter when the piece of footwear this deformed and thus allowing the braking of the roller.

As such, the braking system comprises a triggering device 29 capable of being actuated under the action of the actuation device 28 in order to pass from a position for blocking the plate 11 during skating, according to which the mobile portion 27 is immobilized relatively to the fixed portion 25 so as to prevent both parts from moving closer to each other, and thus prevent the wheels from coming into contact with the braking component 21, to a position for unblocking the plate 11, according to which the mobile portion 27 is able to move closer to the fixed portion 25, notably when the user exerts pressure on the rear portion of the plate in order to deform the latter and to allow the mobile portion 27 to move closer to the fixed portion 25, according to which the wheels come into contact with the braking component 21. Additionally, the triggering device 29 conversely allows passing from the unblocking position to the blocking position under the action of the actuation device 28, or even by means of a return spring system.

As illustrated in FIGS. 1-4, the triggering device 29 consists of a pusher component, preferably consisting of a connecting rod 31 and of a triggering part 33. This connecting rod 31 is firmly attached to the actuation device 28 and allows action by thrust or traction on the triggering part 33 when the actuation device is actuated. For this, the connecting rod 31 is mounted as a pivot link at its first end 35 with the actuation device 28, i.e. with the upper portion 17 of the rod which comprises an assembly part 59 with the connecting rod 31, as illustrated in FIGS. 1-3, or with the part 83 as illustrated in FIG. 4. Additionally, this connecting rod 31 is mounted as a pivot link at its second end 37 with the triggering part 33. When the actuation device 28 is formed by the rod, as illustrated in FIGS. 1-3, the connecting rod 31 is positioned at the rear end of the roller blade 1. Moreover, when the actuation device 28 is formed by the part 83 arranged under the front end 81 of the piece of footwear 79, as illustrated in FIG. 4, this connecting rod is positioned under the piece of footwear and extends through the plate 11 from front to rear. For this, the plate comprises a passage extending longitudinally, notably in the central portion of the latter, so as to pass through the fixed portion 25 and possibly the mobile portion 27, and thereby providing passage for the connecting rod 31 in order to position its upper end 35 above the fixed portion so as to connect it with the part 83 of the actuation device, and to position its lower end 37 at the rear end of the mobile portion 27 so as to connect it with the triggering part 33.

In a preferential but non-limiting way, the connecting rod 31 comprises adjustment means 57 illustrated in FIGS. 1 and 2. These adjustment means in the alternatives illustrated in FIGS. 3 and 4 may be contemplated. With these adjustment means 57, its length may be adjusted, i.e. the length separating the pivot axis arranged between the upper end 35 of this connecting rod and the actuation device 28, from the pivot axis arranged between the lower end 37 of said connecting rod and the triggering part 33. Thus, it is possible to adjust the position for actuating the triggering part 33 when the actuation device is engaged. With this, it is notably possible to take into account the morphology of the user who will tend to modify more or less the position of the actuating device 28 at rest, i.e. in the initial position of the upper portion 17 of the rod or of the part 83 under normal skating conditions. Provision may be made for telescopic adjustment of the connecting rod 31, by changing the length of the connecting rod and therefore the length between the pivot axes. However it is also possible to apply adjustment means 57 on the assembling part 59, as illustrated in FIGS. 1 and 2, or on the actuation part 83, as illustrated in FIG. 4, also allowing them to change the length between the pivot axes on the connection rod 31.

As illustrated in FIGS. 1-4, the triggering part 33 is jointed with the fixed portion 25 of the plate 11 on the one hand and with the mobile portion 27 on the other hand. This triggering part is arranged in order to block the separation between said fixed 25 and mobile 27 portions during the locking or blocking with the purpose of preventing both portions 25, 27 from moving closer to each other and thereby avoiding that the wheels come into contact with the braking component 21. Conversely, in the unlocking or unblocking position, the triggering part 33 allows unblocking between the fixed portion and the mobile portion, so as to allow them to move closer to one another and thereby cause the wheel(s) of the roller blade to contact the braking component 21.

The triggering part 33 is positioned at the rear end 45 of the fixed portion 25 of the plate, as illustrated in FIGS. 1-4. According to the invention, the latter consists of at least one plate 39 with a more or less large thickness, mounted so as to pivot about a transverse axis 43 with the fixed portion 25. However it is possible to design a translatable assembly along a longitudinal axis between said fixed portion 25 and said triggering part 33.

Additionally, the plate 39 is mounted so as to perform circular translation with the mobile portion 27 of the plate 11. For this, the plate 39 comprises a longitudinal recess 47, preferably of circular shape, and the mobile portion 27 comprises at least one axial guiding portion 49 arranged transversely, this axial portion 49 being positioned inside the longitudinal recess 47. Thus, when the plate 39 pivots at its transverse pivot axis 43, or undergoes translational motion relatively to the mobile portion 25, under the action of the connecting rod 31 actuated by the actuation device 28, the longitudinal recess 47 is able to undergo translational motion relatively to said axial portion 49.

When the roller comprises four wheels in line as illustrated in FIGS. 1-3, the triggering part 33 preferably has the shape of a U, illustrated in FIG. 3, both lateral sides 79*a*, 79*b* of which form two plates 39, 41 each provided with a circular longitudinal recess 47 as described above. Moreover, these plates 39, 41 are positioned on the lateral sides of the mobile portion 27 of the plate 11. Additionally, the longitudinal recesses 47 of these plates 39, 41 each receive an axial guiding portion 49 which is in a preferential and non-limiting way formed by a portion of the axis of rotation 51 of one of the rolling systems, notably by the ends of the axis of rotation 51 of the wheel 5*a*. These axial guiding portions may however be independent of the axis of rotation 51, and, for example, be applied by means of added parts, such as nipples, added onto the lateral sides of the mobile portion 27.

When the roller blade 1 has a design as illustrated in FIG. 4, i.e. it consists of two rolling systems in line, each rolling system comprises two wheels 5*c*, 5*d*, 7*d* rotatably mounted along the axis 51, the wheels being positioned on the lateral sides of the mobile portion 27, the triggering part 33 then consists of a single plate 39, with a larger thickness, preferably of the order of 5-10 mm, positioned in the central portion at the rear end 45 of the plate, as illustrated in FIG. 4. In this case, the axial guiding portion 49 is formed by the central portion of the axis of rotation 51. Moreover, it is possible to provide an intermediate part 49*a* mounted on the portion of the axis of rotation 51, or even on an axis independent of said axis of rotation, this intermediate part 49*a*, illustrated in FIG. 4, being engaged into the recess 47 on the plate 39. Such an intermediate part 49*a* has the function of improving the sliding of the triggering part 33; it may for example consist of a sliding ring freely mounted on the axis 51 or of a bearing. Such an intermediate part 49*a* may also be contemplated for the embodiments illustrated in FIGS. 1-3, in which case two intermediate parts will be applied on each lateral side of the roller blade, at the longitudinal recesses 47 on the plate 49, 51.

The triggering part 33 illustrated in FIGS. 1-4 has a longitudinal recess 47, the shape of which is able to change, i.e. the radius separating the pivot axis 43 of said triggering part 33 relatively to the fixed portion 25 and the upper perimeter 48 of the recess in which the axial guiding portion 49 will be housed, decreases gradually. This changing shape of the recess 47 is preferably circular and arranged so that in the normal skating position, the upper side 50 of the axial guiding portion 49 is blocked by the upper perimeter 48 of the recess 47 which is positioned on the side of its first end 53, as illustrated in FIG. 2. According to this position, the centerline distance separating the pivot axis 43 and the axial portion 49, in contact on the upper perimeter 48, is maximum $e_M$, this maximum centerline distance $e_M$ corresponding to the clearance position of the wheels 5*a*, 7*a* with regard to the braking roller 21*a*.

Conversely, when the roller is in the braking position, i.e. when the connecting rod 31 is actuated by the actuation device 28, the triggering part 33 pivots, the axial portion 49 being then positioned on the side of the second end 55 of the recess 47, as illustrated in FIG. 1, the upper side 50 of said axial portion 49 then preferably being clear of the perimeter 48 of the recess, or even in contact with the latter. However according to this position, the centerline distance is minimum $e_m$, this minimum centerline distance $e_m$ being notably obtained when the user exerts pressure on the rear portion of the plate with the foot in order to deform the latter so as to bring the mobile portion 27 closer to the fixed portion 25 until the wheels 5*a*, 5*b* of the rolling systems 5, 7 come into contact with the braking component 21*a*.

This operating mode is equivalent for the roller blade 1 as illustrated in FIG. 4 with the difference that the triggering part 33 consists of a single plate 39, the operating characteristics of which are identical to those described earlier and illustrated in FIGS. 1-3, allowing either both rear wheels 5*c*, 5*d* of the rear rolling system 5 to contact with the braking rollers 21*c*, 21*d*, or maintaining apart the mobile portion 27 from the fixed portion 25 in order to prevent the contact of said wheels 5*c*, 5*d* with said rollers 21*c*, 21*d*.

Additionally, when the plate 39 is mounted translationally along a longitudinal axis with regard to the fixed portion 25, the centerline distance is defined by the distance separating said longitudinal translation axis from the upper perimeter 48 of the recess 47 which, according to this design embodiment, may have a linear and tilted shape so as to vary the distance from the maximum centerline distance $e_M$ to the minimum centerline distance $e_m$, and vice versa.

The longitudinal recess 47 may comprise different design embodiments. Indeed, according to a first design embodiment illustrated in FIG. 3, this recess 47 opens out at the lower end of the triggering part 33, i.e. at the lower end of the plate 39, 41. Such a recess design 47 has the function of providing a contact of the upper side 50 of the initial portion 49 with the upper perimeter 48 of said recess 47 so as to provide the contact between both of these components in the skating position, as described above, and thereby prevent the mobile portion 27 from moving closer to the fixed portion 25.

According to an alternative design of the recess 47 as illustrated in FIGS. 1 and 2 and in FIG. 4, the latter is formed by a lumen with a circular shape, this circular shape preferably having a flared shape on the downstream side of the plate 39, 41. With this flared circular shape, firstly it is possible to provide a contact of the upper side 50 of the axial portion 49 with the upper perimeter 48 of said lumen, at its first end 53, and secondly it is possible to introduce vertical play between said upper side 50 of the axial portion 49 and said upper perimeter 48, on the side of its second end 55, so as to provide clearance between both components providing, when the user exerts pressure on the heel during the braking, sufficient deformation of the plate 11 according to which the mobile portion 27 moves closer to the fixed portion 25, so that the wheel(s) 5*a*, 7, 5*c*, 5*d* of the rolling system(s) 5, 7 come into contact on the roller(s) 21*a*, 21*c*, 21*d*, i.e. the minimum centerline distance $e_m$ may be attained.

Additionally, this lumen forming said recess 47 has the function of limiting the separation between the mobile portion 27 and the fixed portion 25 during skating, and possibly during braking. Indeed, the lower perimeter 52 of the lumen 47 is able to enter into contact with the lower side 54 of the axial portion 49, which prevents too large separation between the mobile portion and the fixed portion. Moreover, the lower perimeter 52 of the lumen forms a wall preferably comprising a circular shape arranged so as to limit the separation between both fixed 25 and mobile 27 portions, both during skating and during braking. This wall with a circular shape may further undergo changes, in a way identical with that described above, the contact between the lower side 54 of the axial portion 49 and the wall of the lower perimeter 52 of the lumen forcing the mobile portion 27 to move closer to the fixed portion 25 in order to attain the minimum centerline distance $e_m$, notably when the user does not exert sufficient pressure with the heel for deforming the plate 11.

According to an alternative, the connecting rod 31 consists of two parts slidably mounted relatively to each other. The upper part comprises an adjustment screw forming said means for adjusting the length of the connecting rod, the latter allowing the length of the connecting rod to be limited when the actuation device 28 is actuated. Additionally, the telescopic mounting between the upper portion and the lower portion of the connecting rod 31 allows the latter to be extended while avoiding any action on the triggering part 33, so as to prevent its return to the initial locking position when the roller blade is being slowed down. Such a design of the connecting rod 31 is of interest notably when the actuation device 28 is such as that in FIGS. 1-3. However it may be applied with the actuation device 28 as illustrated in FIG. 4 and consisting of a part arranged under the front end of the sole of the piece of footwear.

Thus, as illustrated in FIGS. 1-3, when the actuation device 28 is formed by a rod, the action on the upper portion 17 of the rod causing the pivoting of the latter towards the front of the roller, acts by extending the connecting rod 31 without any effect on the triggering device 33. On the contrary, when the upper portion of the rod is actuated towards the rear of the roller blade, the latter pivots downwards causing sliding of the upper portion of the connecting rod 31 relatively to the lower portion of the latter until the adjustment screw 51*a* firmly attached to the upper portion abuts on the upper end of the portion of said connecting rod. The connecting rod is then driven downwards and actuates the triggering part 33 so as to cause it to pivot and to allow unlocking of said triggering part 33 so that the mobile portion may move closer to the fixed portion, as illustrated in FIG. 6.

The triggering part 33 may also comprise a return component such as a spring, applied on the triggering part 33 as illustrated in FIGS. 1-3 and FIGS. 1-4, this return component being arranged between said triggering part 33 and the fixed portion 25 of the plate so as to ensure rotation or translation of said triggering part 33 in order to ensure its return into the blocking position.

Preferentially, the braking component 21 is applied by means of a braking roller as illustrated in FIGS. 1-4. The rotary movement of the roller has the advantage of friction between two mobile parts which allows gradual braking unlike the friction between a fixed part and a mobile part which may generate a risk of blocking the system and consequent jolts.

Figure 5:
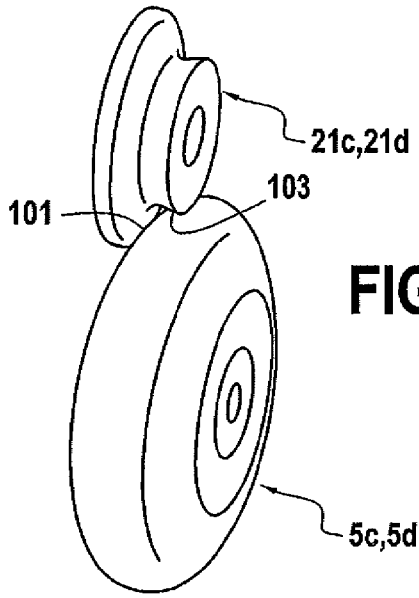
FIG. 5 illustrates an exemplary application of the braking component, notably arranged on the roller blade illustrated in FIG. 4.

This braking roller 21*c*, 21*d* preferably comprises a profile which is arranged so as to have at least two points of contact 101, 103 with the wheel 5*c*, 5*d*, these contact points 101, 103 being located at radii having a different length relatively to each other as illustrated on an example in FIG. 5. Thus, two contact points between the wheel and the roller are provided, causing different speeds at two contact points between the rollers and the wheel, having the effect of generating friction directly between the roller and the wheel, without it being necessary to use an additional braking component acting on said roller 21 for braking the latter and transferring said braking to the wheels, this latter solution however remaining conceivable with the use of a traditional roller.

According to an alternative design, it is possible to replace said braking roller 21*a*, 21*b*, 21*c*, 21*d* with another braking component 21 of the fixed braking pad type on the mobile portion 25, and said pad preferably having a circular shape adapted to the shape and to the radius of the wheels of the roller blade.

As described earlier, the pusher of the triggering device 29 is applied by means of a connecting rod 31 actuated under the effect of the actuation device 28 and with which the movement of the triggering part 33 may be driven. However, it would be possible to design a pusher of an electronic and/or magnetic type remotely actuated by the actuation device 28, for example of the control box type, the remote triggering of said pusher allowing the latter to act on the triggering part 33 in order to move it into the position for blocking the mobile portion 27 and the fixed portion 25, or conversely the position for unblocking said portions. This pusher may further consist in the combination of a servomechanism or an actuator associated with a connecting rod, the servomechanism or actuator being actuated by a control button.

Preferentially, the braking pad, according to the different alternatives illustrated in FIGS. 1-4, comprises means for blocking the pad in the skating position ensuring that the pad is maintained in a remote position between the fixed portion 25 and the mobile portion 27, these blocking means may for example consist in a locking catch forming an abutment on the triggering part 33 so as to prevent actuation of the latter and retain the skating position. Such blocking means have a remarkable advantage when the skate is used under extreme conditions, for example for performing figures or acrobatics; they also allow the skate to be occasionally blocked for such a use, the user only having to neutralize said blocking means when he/she wishes to be able to use the braking system again.

The invention claimed is:

1. A roller skate comprising a frame, at least two rolling systems each having at least one wheel rotatably mounted on a transverse axis of rotation, and at least one braking component, the frame comprising at least one longitudinal plate on which the rolling systems and a foot blocking device for firmly attaching the foot to the roller skate are mounted inline, said plate having two portions, a fixed portion and a mobile portion, the fixed portion is firmly attached to the blocking device and receives at least said braking component, and the mobile portion receives at least one of the rolling systems positioned under the braking component in order to come into contact with the braking component, and to slow down the braking component when the mobile plate moves closer to the fixed portion, a roller comprising an actuation device arranged on the frame so as to be notably controlled with the foot or the leg of the user, characterized in that wherein said roller skate comprises a pusher and a triggering part, said pusher being linked to the actuation device, and to the triggering part, said triggering part having at least one plate adjacent to the rolling system, said plate being mounted so as to rotate about a transverse axis or to undergo longitudinal translational motion with the fixed portion and translationally with the mobile portion for passing from a locking position to an unlocking position under the action of the actuation device, said plate blocking the separation between said fixed and mobile portions during locking, and on the contrary, allowing the fixed and mobile portions to move closer to one another during unlocking.

2. The roller skate according to claim 1, wherein the longitudinal plate is slit over a portion of its length, so as to form both the fixed and mobile portions and allow said mobile portion to move closer to said fixed portion by elastic deformation of said plate.

3. The roller skate according to claim 1, wherein the plate comprises a longitudinal recess, the mobile portion comprising at least one axial guiding portion arranged transversely and positioned inside the longitudinal recess, with regard to which the guiding portion is capable of undergoing translational motion.

4. The roller skate according to claim 3, wherein the at least one axial guiding portion is formed by a portion of the axis of rotation of one of the rolling systems, said axial portion being optionally provided with an intermediate part facilitating sliding.

5. The roller skate according to claim 3 wherein the shape of the longitudinal recess is able to change, so that the distance separating the pivot axis or the longitudinal transactional axis of the plate from the upper perimeter of said recess receiving the axial guiding portion gradually decreases, and in a normal skating position, an upper side of said axial guiding portion is blocked by the upper perimeter, on the side of the first end of the recess, the centerline distance separating the pivot axis or the longitudinal translational axis from the axial portion being maximum $e_M$ and corresponding to a clearance position of the rolling system with regard to the braking component, while in a braking position, the axial portion is positioned on a side of a second end of the recess and the upper side of the axial portion is possibly clear of said upper perimeter, the centerline distance between minimum $e_m$ and corresponding to a contact position of the roiling system on the braking component.

6. The roller skate according to claim 5, wherein the longitudinal recess has a lumen comprising a flared shape on a downstream side of the plate for introducing vertical play between the upper side of the axial portion and the upper perimeter of said recess, on the side of the second end, with which the minimum centerline distance $e_m$ may be attained.

7. The roller skate according to claim 6, wherein a lower perimeter of the lumen forms a wall, arranged in order to limit the separation distance between the mobile portion and the fixed portion.

8. The roller skate according to claim 1 wherein the pusher is a connecting rod which comprises adjustment means arranged for adjusting length and the position of the connecting rod actuating the triggering part when the actuation device is actuated.

9. The roller skate according to claim 8 wherein the braking component has a roller rotatably mounted along a transverse axis of rotation on the fixed portion, and the rolling system has a single central wheel rotatably mounted on the axis of rotation and capable of coming into contact with the roller when the mobile portion moves closer to the fixed portion.

10. The roller skate according to claim 3, wherein the triggering part has the shape of a "U", both lateral sides of which form two plates are each provided with a circular longitudinal recess, said two plates being positioned on lateral sides of the mobile portion, the ends of the axis of rotation forming both axial guiding positions positioned in said recesses.

11. The roller skate according to claim 1, wherein the braking component has two rollers rotatably mounted along a transverse axis of rotation on the lateral sides of the fixed portion, and the rolling system has two wheels rotatably mounted on the axis of rotation, the wheels being positioned on the later sides of the mobile portion and capable of coming into contact with the rollers when the mobile portion moves closer to the fixed portion.

12. The roller skate according to claim 5, wherein the triggering part has a single plate located in the central portion at the rear of the at least one longitudinal plate, the axial guiding portion being formed by a central portion of the axis of rotation.

13. The roller skate according to claim 9, wherein the roller comprises a profile arranged so as to have at least two points of contact with the wheel, these contact points being located at radii of different lengths in order to exert direct friction between the roller and the wheel.

14. The roller skate according to claim 1, wherein the actuation device has a rod which includes as least two portions jointed together, notably at ankle bone level, along a transverse pivot point axis, the first portion surrounding at least a heel of a foot and the second portion surrounding at least the lower portion of a calf, the pivoting of the second portion of the rod allowing the pusher to be actuated.

15. The roller skate according to claim 1, wherein the foot blocking device has a piece of footwear, a front end of which is capable of deforming, the actuation device having a part arranged under said front end of the piece of footwear and firmly attached to the pusher (31) of the braking system, said deformation of the piece of footwear allowing said part to be moved and said pusher (31) to be actuated.

16. The roller skate according to claim 1, wherein the blocking device is arranged so as to occasionally block the position of the triggering part in the locking position during skating.

* * * * *